US006950075B1

(12) United States Patent
Rivera

(10) Patent No.: US 6,950,075 B1
(45) Date of Patent: Sep. 27, 2005

(54) GPS ANTENNA FOR SUBMARINE TOWED BUOY

(75) Inventor: David F. Rivera, Westerly, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 28 days.

(21) Appl. No.: 10/730,185

(22) Filed: Dec. 8, 2003

(51) Int. Cl.[7] ..... H01Q 3/00
(52) U.S. Cl. ..... 343/762; 343/709
(58) Field of Search ..... 343/709, 710, 343/757, 762, 763

(56) References Cited

U.S. PATENT DOCUMENTS

| | | | | | |
|---|---|---|---|---|---|
| 3,893,123 | A | * | 7/1975 | Bieser | 343/706 |
| 3,942,180 | A | | 3/1976 | Rannou et al. | 343/725 |
| 4,030,100 | A | | 6/1977 | Perrotti | 343/709 |
| 4,227,479 | A | * | 10/1980 | Gertler et al. | 114/312 |
| 4,596,989 | A | * | 6/1986 | Smith et al. | 343/709 |
| 4,920,350 | A | * | 4/1990 | McGuire et al. | 343/709 |
| 5,512,912 | A | * | 4/1996 | Ross et al. | 343/765 |
| 5,749,549 | A | * | 5/1998 | Ashjaee | 248/168 |
| 5,922,039 | A | * | 7/1999 | Welch et al. | 701/116 |
| 6,094,174 | A | | 7/2000 | Knop et al. | 343/781 R |
| 6,211,837 | B1 | | 4/2001 | Crouch et al. | 343/786 |
| 6,292,147 | B1 | | 9/2001 | Ham | 343/702 |

* cited by examiner

*Primary Examiner*—Shih-Chao Chen
(74) *Attorney, Agent, or Firm*—Michael P. Stanley; James M. Kasischke; Jean-Paul A. Nasser

(57) ABSTRACT

An apparatus including a gimbal and an antenna with a hollowed frustum having a closed end and an open end. The antenna includes a feed stem at the closed end extending as an internal rod into the hollowed frustum. The opposite end of the rod connects to a receiver section extending from an edge of the open end beyond a longitudinal axis of the antenna. The antenna is supported by the gimbal attachable to a container suitable for towing. A pivot at the open end in relation to the center-of-gravity of the frustum allows a swinging arc in relation to the attached gimbal in that the frustum moves by gravity toward the axes of the gimbal such that the receiver section maintains a facing position to the force of gravity.

13 Claims, 6 Drawing Sheets

GPS ANTENNA FOR SUBMARINE TOWED BUOY

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates to antennas and more particularly to a global positioning system (GPS) antenna.

(2) Description of the Prior Art

In the field of GPS technology, GPS receivers are used to determine the geographic location of the receiver by receiving microwave radio signals from a group of earth-orbiting GPS satellites. The geographic location of the receiver may be computed by calculating its distance from each satellite as the result of determining how long the signals take to travel from the satellite to the receiver. Typically, a flat GPS antenna element is utilized by GPS receivers to receive the signals transmitted. In order for the GPS receiver to compute its geographic location, the antenna element of the receiver must be oriented to receive an acceptable level of the signals. Optimally, the flattened surface of the GPS antenna element is righted against the force of gravity such that a maximum surface area of the antenna faces the satellites.

Present submarine communications with battlegroups or satellites utilize surface antennas for a variety of requirements including global positioning and communications. The use of surface antennas typically interferes with the covert operation of the submarine. For example, submarines obtaining position fixes using GPS must raise a mast containing an antenna which is oriented to receive the signals from the GPS satellites. The problem is that raising a mast renders the submarine vulnerable to either visual or radar detection, especially if the mast is raised in coastal or littoral areas.

Additionally, antennas used on the ocean surface are subjected to dynamic forces that act to cause the antenna to pitch, yaw and sometimes roll with the vessel under varying sea states. These antenna movements can easily re-orientate the receiving element of the antenna resulting in reception interruption. Varying sea states also cause a detuning effect that result in degradation of the patch elements of conventional GPS antennas. To minimize the effects of varying sea states, the submarine must operate in a station keeping status or must constantly adjust course headings.

One method of mitigating reception interruption of the antenna is to orient the flattened surface of the antenna to right itself or face "up" toward the sky irrespective of the movement of its supporting structure. In Ham (U.S. Pat. No. 6,292,147), an apparatus for maintaining a GPS antenna element at a predetermined orientation is disclosed. The apparatus includes a holder configured to support a GPS antenna element in which the holder includes a rectangular frame as a receiving portion of the dielectric substrate of antenna. The rectangular holder pivots on an axis in relation to gravity to the predetermined orientation even when the base structure to which the holder is coupled changes its orientation. While the disclosed reference allows a righting motion to the antenna element, the movement of the righting motion is limited to rotation around the axis of the pivot in which the rotation provides only one degree of freedom.

It is well known in the use of gyroscopes and in the use of compasses on ships, that a gimbal provides at least two degrees of freedom for either attached device by allowing a pivoting action on the axes of the gimbal in which the axes are rotatable at angles to each other. For example, the pivoting and rotating action of a gimbal used on a ship compensates for the roll and the yaw of the ship as well as the pitch of the ship thereby maintaining an accurate heading of a compass set in the gimbal.

As such, an improvement to the technology of GPS antennas would be to incorporate the degrees of freedom of a gimbal with a conformable GPS antenna in a manner that is suitable for use on a vessel or towed array as well as for use in any other situation that can require more than one degree of freedom in which the degree of freedom is needed to maintain the righting or facing up element of the antenna receiver. Such an improvement along with any other suitable improvements to the structure of the GPS antenna could act to minimize the reception interruptions and the detuning effects caused by varying sea states.

SUMMARY OF THE INVENTION

Accordingly, it is a general purpose and primary object of the present invention to provide an apparatus with a Global Positioning System (GPS) antenna that can obtain geographic positioning data with minimal interruption when operating in varying sea states.

It is a further object of the present invention to provide an apparatus with an antenna that can transmit and receive signal communications with minimal interruption when operating in varying sea states.

It is a still further object of the present invention to provide an apparatus with antenna that can be towed by a submarine.

It is a still further object of the present invention to provide an apparatus with antenna in which the construction is simple and economical.

It is a still further object of the present invention to provide an antenna capable of transmission at high frequencies with minimal degradation.

It is a still further object of the present invention to provide an antenna in which the construction is simple and economical.

To attain the objects described, there is provided an apparatus with a GPS antenna in which the antenna maintains a receiving area that faces toward the sky or ocean surface. The antenna is a hollowed frustum having a closed end at its decreased diameter and an integral base ring surrounding an open end at an increased diameter of the frustum. The antenna includes a feed stem at the closed end extending as an internal rod in the interior of the frustum. The opposite end of the internal rod connects to a receiver plate in which the receiver plate extends from the base ring toward and beyond a longitudinal axis of the frustum.

For use in vessel operations or other applications that require the receiver plate to face the sky or the ocean surface, the antenna is supported by a gimbal. The gimbal is attachable to the interior of a watertight container suitable for towing horizontally on the ocean surface.

During operations, the pivoting of the antenna at the open end in relation to the lower center-of-gravity of the frustum shape of the antenna allows an enhanced swinging arc in relation to the attached gimbal in that the body of the frustum moves by gravity toward the axes of the gimbal. As such, the antenna provides the righting or facing up of the open end of the frustum and a facing up of the flattened surface of the attached receiver plate thereby permitting enhanced reception by the antenna. Furthermore, the antenna itself and not a holder of the antenna provides the righting or facing up motion thereby allowing a reduction in the amount of parts and a simplicity in design.

During actuation of the antenna, the feed stem is conductive to an energized feed source. Radio-frequency energy from the feed stem continues to the frustum with the energy disbursing as a current distribution along the interior surface of the frustum. The radio-frequency energy from the feed stem also continues onto the receiver plate with the result of a current distribution across the receiver plate. The differences in phase and amplitude from the radiating surface of the frustum, and the receiver plate contributes to a hemispherical radiation pattern in the far field.

The hemispherical radiation pattern is advantageous because when the antenna is placed on the ocean surface, the radiation pattern in the air space above the ocean surface does not contain nulls. As such, the radiation pattern in the air space permits full directionalized reception from GPS satellites or other signal emitting sources.

Furthermore, the antenna of the present invention reduces the degradation and associated problems with detuning occurring during various sea states. Specifically, the impedance matching of the frustum shape and the components of the antenna control the impedance influence of the detuning. Also, the structure of the curved frustum shape removes the edges of a typical patch antenna in which the edges of the typical patch antenna are subject to degradation from detuning.

The above and other features of the invention, including various and novel details of construction and combinations of parts will now be more particularly described with reference to the accompanying drawings and pointed out in the claims. It will be understood that the particular devices embodying the invention are shown by way of illustration only and not as the limitations of the invention. The principles and features of this invention may be employed in various and numerous embodiments without departing from the scope of the invention.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein.

DESCRIPTION OF THE PREFERRED EMBODIMENT

Figure 1:
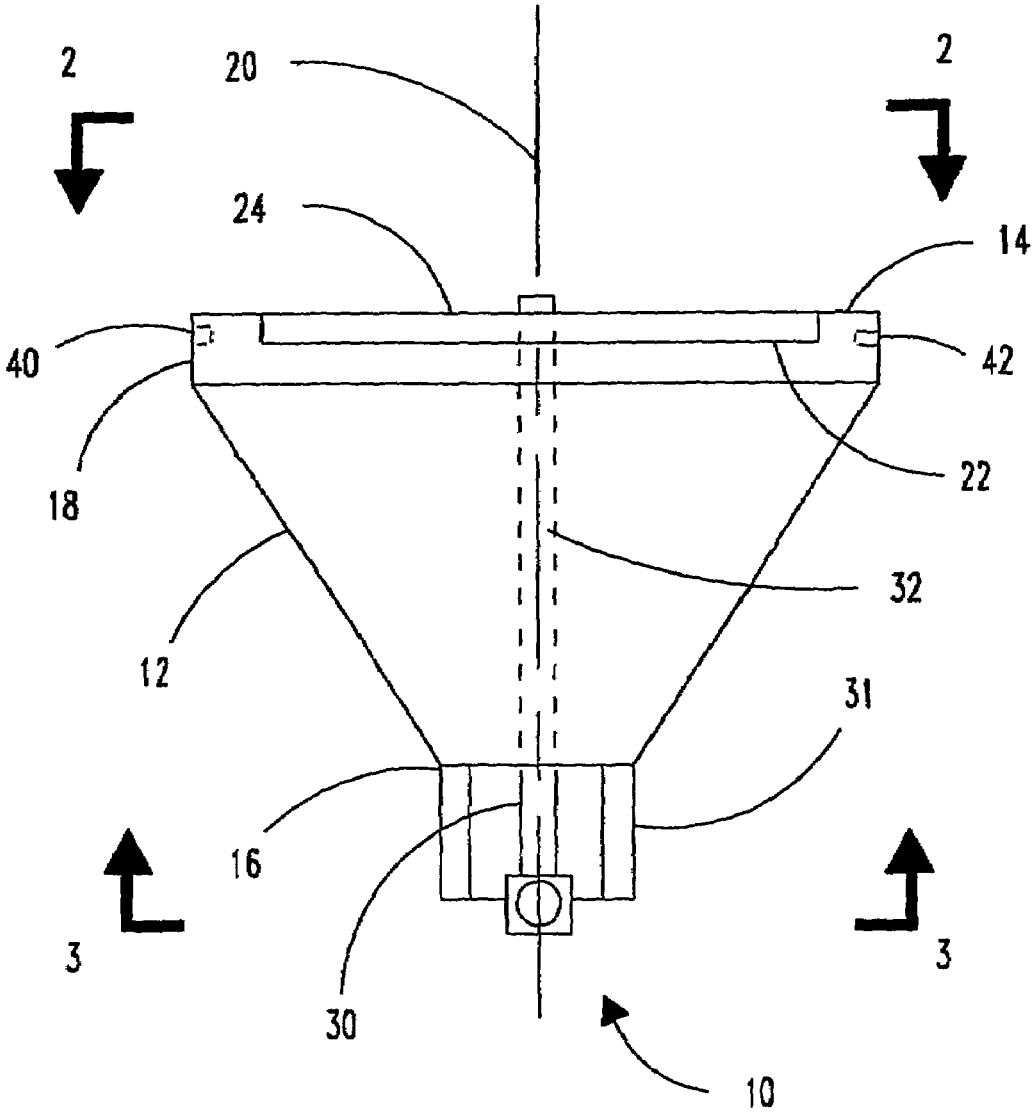
FIG. 1 is a side view of the antenna of the present invention.

Referring now to the drawings wherein like numerals refer to like elements throughout the several views, one sees that FIG. 1 depicts the antenna 10 of the present invention. The antenna 10 is preferably cast with a rigid thickness from phosphor bronze or beryllium copper with electrically conductive components attached or also cast as part of the antenna. Other commonly acquired materials resistant to corrosion in a sea environment or materials known to those skilled in the art may be used in forming the antenna 10.

The simplified structure of the antenna 10 comprises a hollowed frustum 12 having an open end 14 and a closed end 16 with a distance between the closed end and the open end being approximately $\lambda/9$, wherein $\lambda$ is the free-space wavelength measured in meters. For GPS use, the free-space wavelength equals the center frequency of operation, [the square root of the multiplication of the GPS frequencies (1227 MHz, 1575 MHz)] divided by the speed of light. The sizing of the diameter of the frustum 12 as well as the sizing of the other components of the antenna 10 is based on the free-space wavelength thereby allowing the antenna to be sized at a substantial bandwidth for alternate functions such as receiving and transmitting signals from IRIDIUM satellites (1625 MHz).

Figure 2:
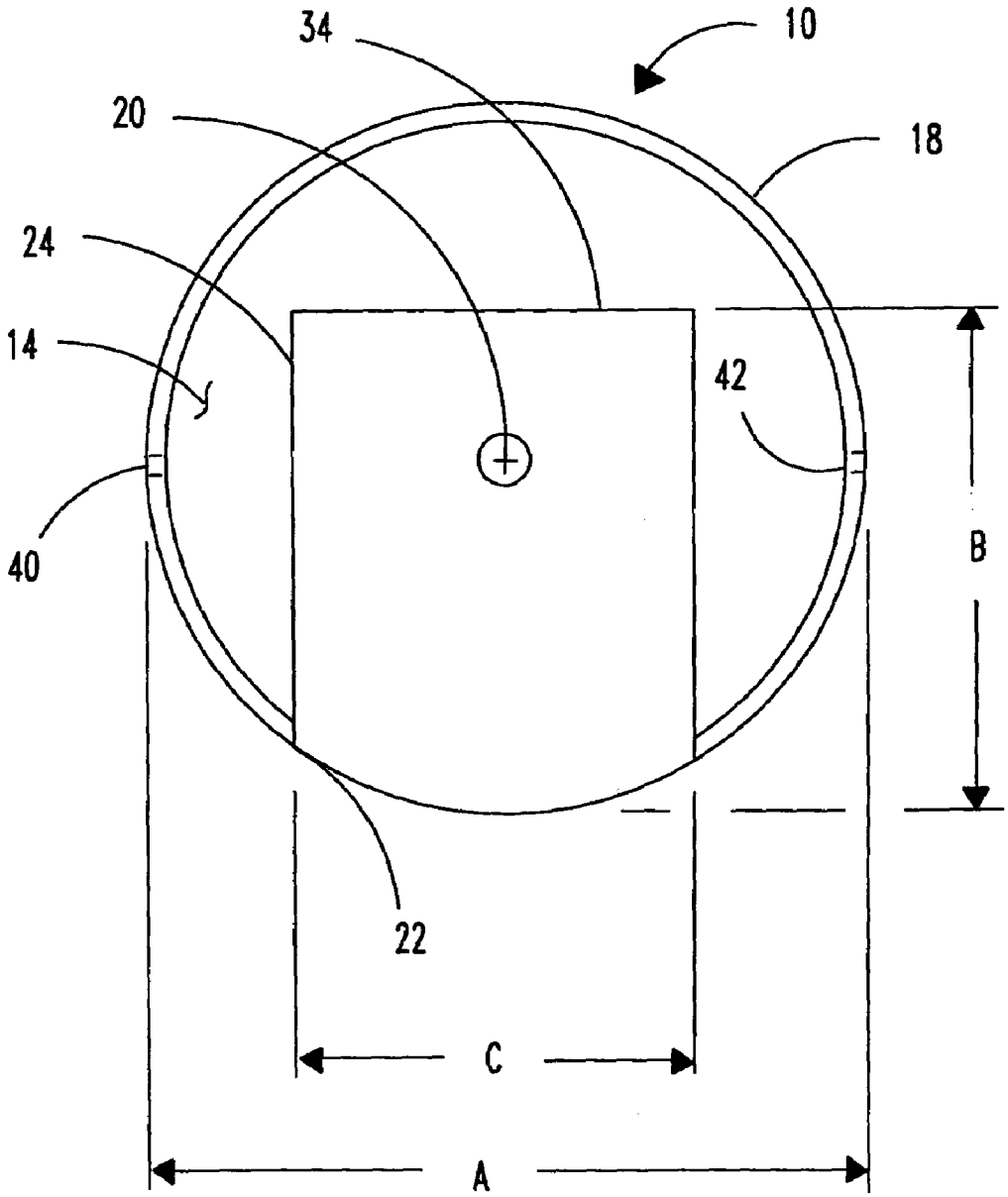
FIG. 2 is a plan view of the antenna of the present invention with the view taken from reference line 2—2 of FIG. 1.

For the open end 14 of the frustum 12 shown in FIG. 2, the open end has a diameter "A" of $2\lambda/5$. An integral base ring 18 projects from the open end 14 parallel to a longitudinal axis 20 of the antenna 10 in which the longitudinal axis is preferably perpendicular to the open end 14 and the closed end 16. The base ring 18 includes a notch 22 to position a receiver plate 24 flush with the projection of the open end 14. The receiver plate 24 extends from the notch 22 to and beyond the longitudinal axis 20. The receiver plate 24 is generally rectangular in shape from the flush with the notch 22 with the rectangular shape having a nominal length "B" of $\lambda/3$ and a width "C" that is approximately ten percent less than the length "B".

Figure 3:
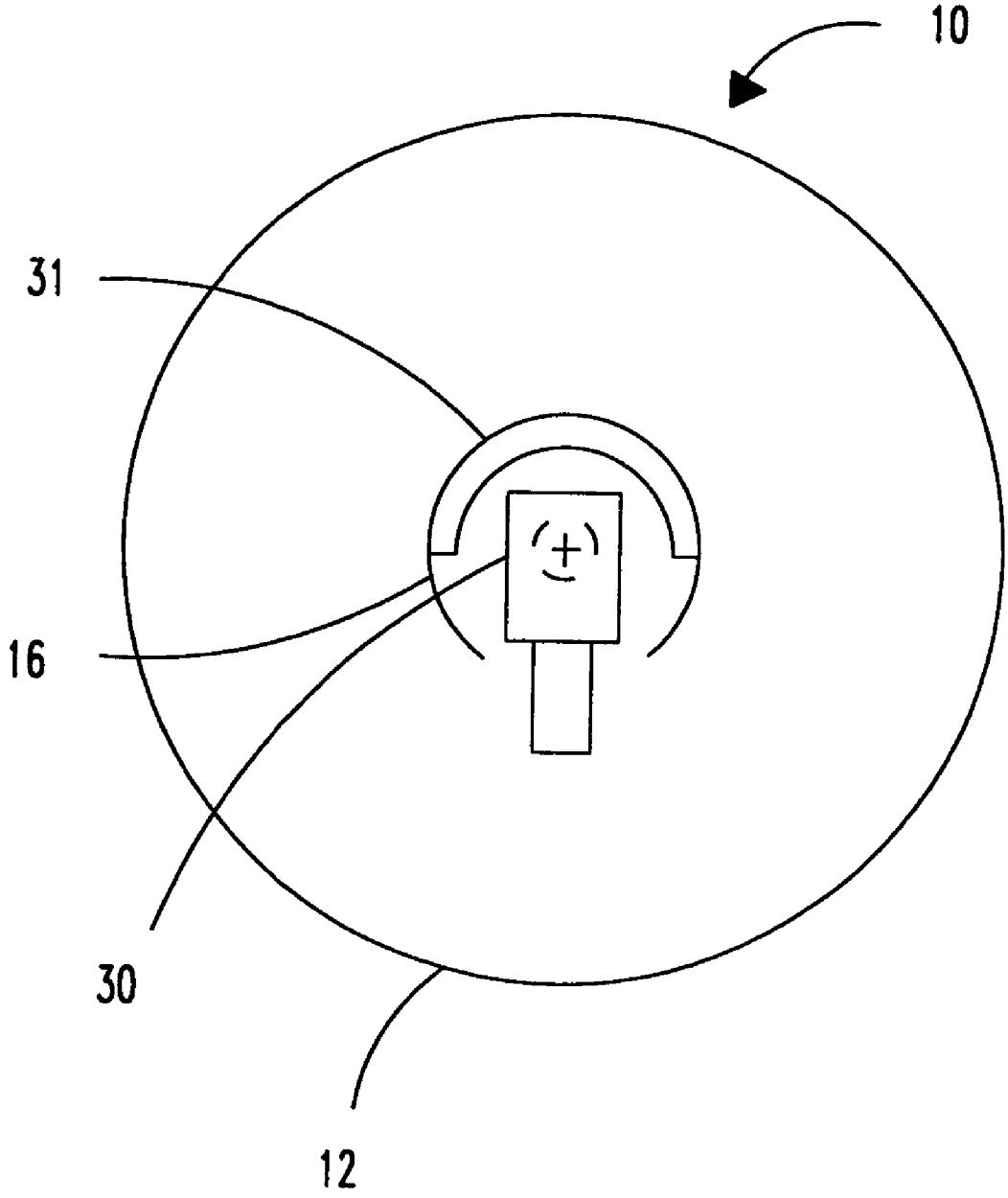
FIG. 3 is an alternate plan view of the antenna of the present invention with the view taken from reference line 3—3 of FIG. 1.

For the closed end 16 of the frustum shown in FIG. 3, the closed end 16 has a diameter of $\lambda/5$. The closed end 16 includes a feed stem 30 shielded by an extension 31 of the frustum 12. The feed stem 30 extends as an internal rod 32 in the cavity of the antenna 10. See FIG. 1. For an optimum impedance match and bandwidth to the antenna structure described above, the diameter of the rod 32 is $\lambda/30$ with a length of $\lambda/10$ and a contact point for the receiver plate 24 at $\lambda/11$ from the plate edge 34. The depth of the cavity (noted above as the distance between the open end 14 and the closed end 16), the size (the length "B" and the width "C") of the receiver plate 24 and the size of the rod 32 determine the impedance at the feed stem 30, the radiation pattern 36 of the antenna 10 and the bandwidth of the antenna 10.

Figure 4:
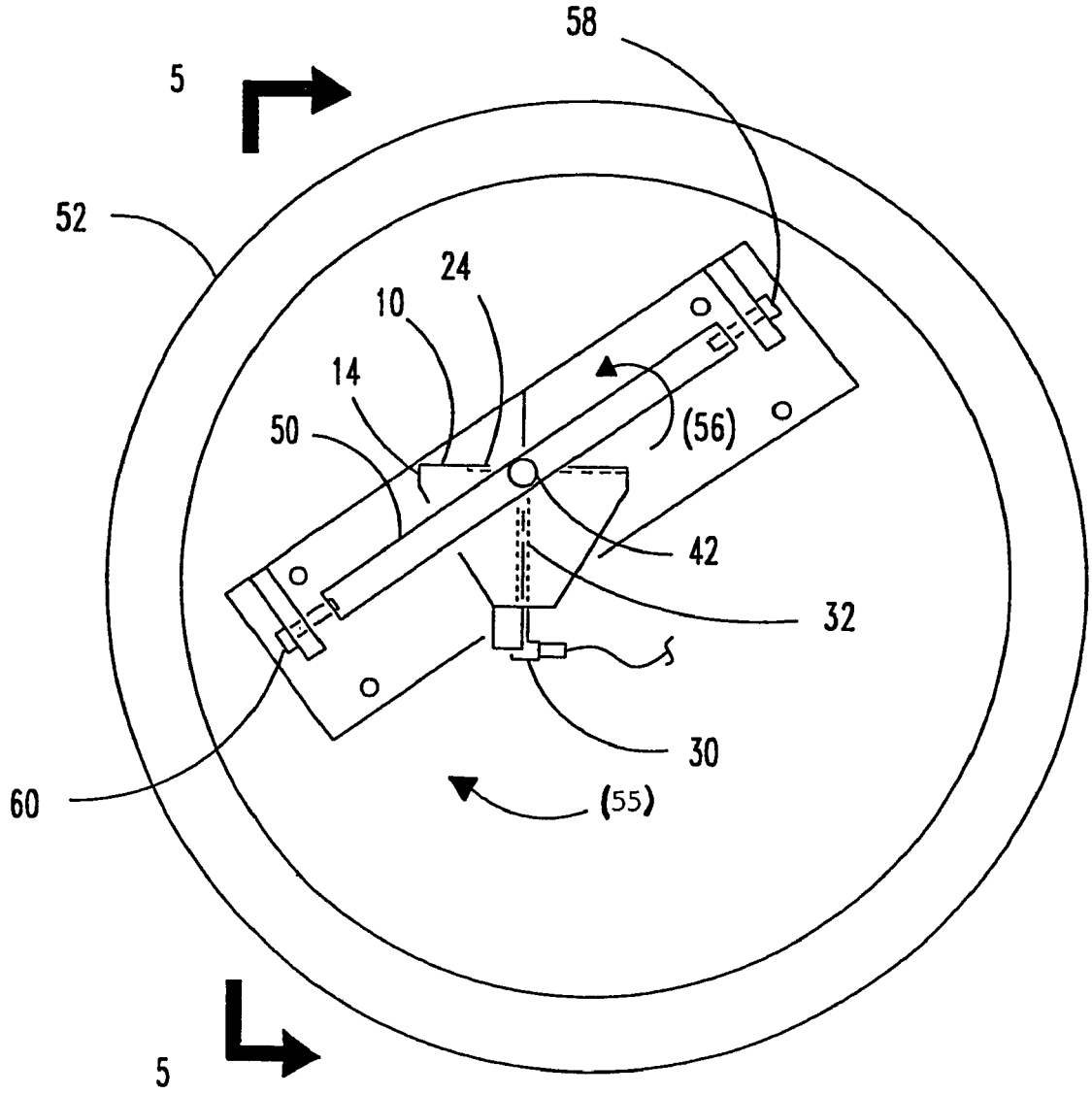
FIG. 4 is a side view of the antenna of the present invention with the antenna mounted on a gimbal positioned in an antenna housing.
Figure 5:
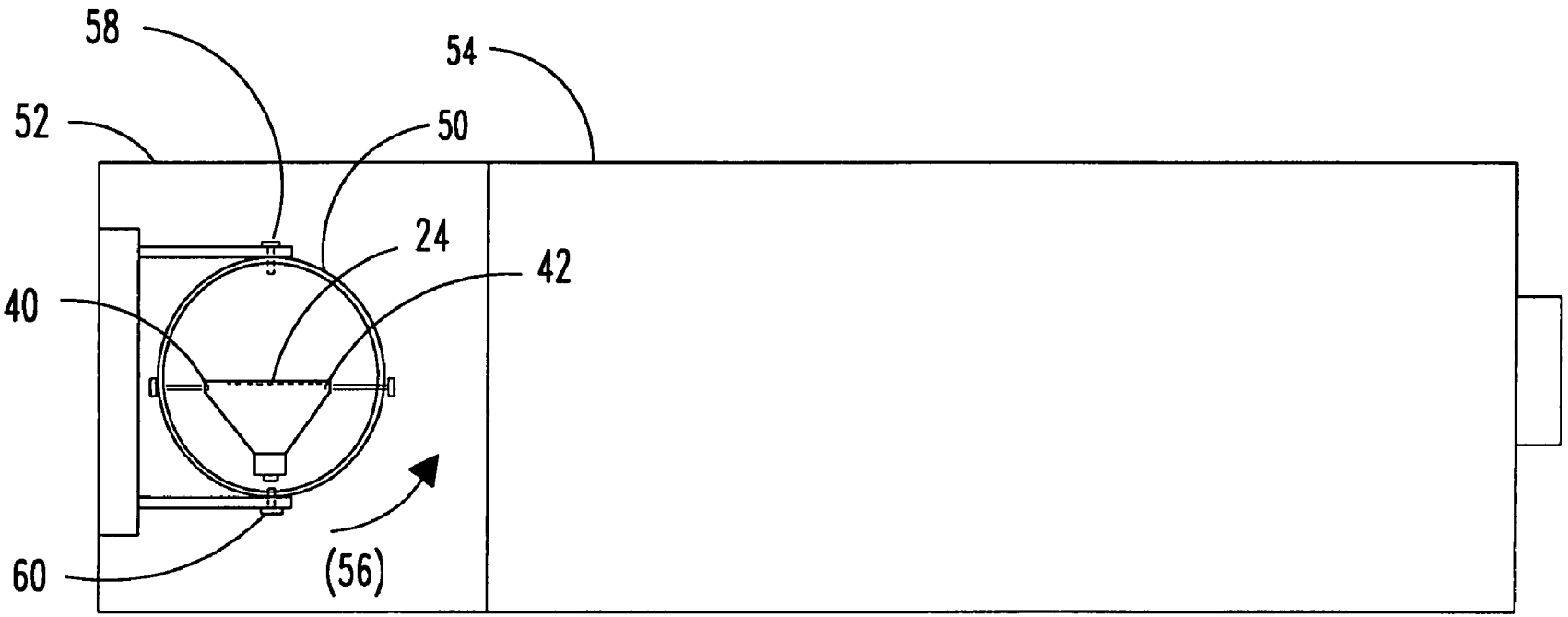
FIG. 5 is a cross-sectional view of the antenna housing attached to a tow body with the view taken from reference line 5—5 of FIG. 4.

Referring again to FIG. 2, the base ring 18 includes attachment points 40, 42 in which the points allow the insertion of a swivel axis or any other mechanical attachment to a gimbal 50, described below. As shown in FIG. 4 for the use of the antenna 10 in submarine operations, the antenna 10 is supported by the gimbal 50 attached to the interior of the watertight container 52. The watertight container 52 is electrically transparent polyethylene and is attachable to a tow body 54 (shown in FIG. 5) which can be towed by a submarine or other vessel.

The pivoting at the attachment points 40, 42 of the antenna 10 in relation to the lower center-of-gravity of the frustum shape of the antenna allows an enhanced swinging arc by gravity (55) on the axis of the attachment points 40, 42 in relation to the attached gimbal 50. The gimbal 50 in turn has a swinging arc (56) on its own attachment points 58, 60; thereby providing a righting movement for the antenna 10 on at least two axes. As such, the antenna 10 provides the righting or facing up of the open end 14 of the frustum and a facing up of a flattened surface of the receiver plate 24 toward overhead satellites thereby permitting enhanced reception by the antenna. The antenna 10 is further unique in that the antenna itself and not a holder of the antenna provides the righting or facing up motion thereby allowing a reduction in moving parts and a simplicity in design.

Figure 6:
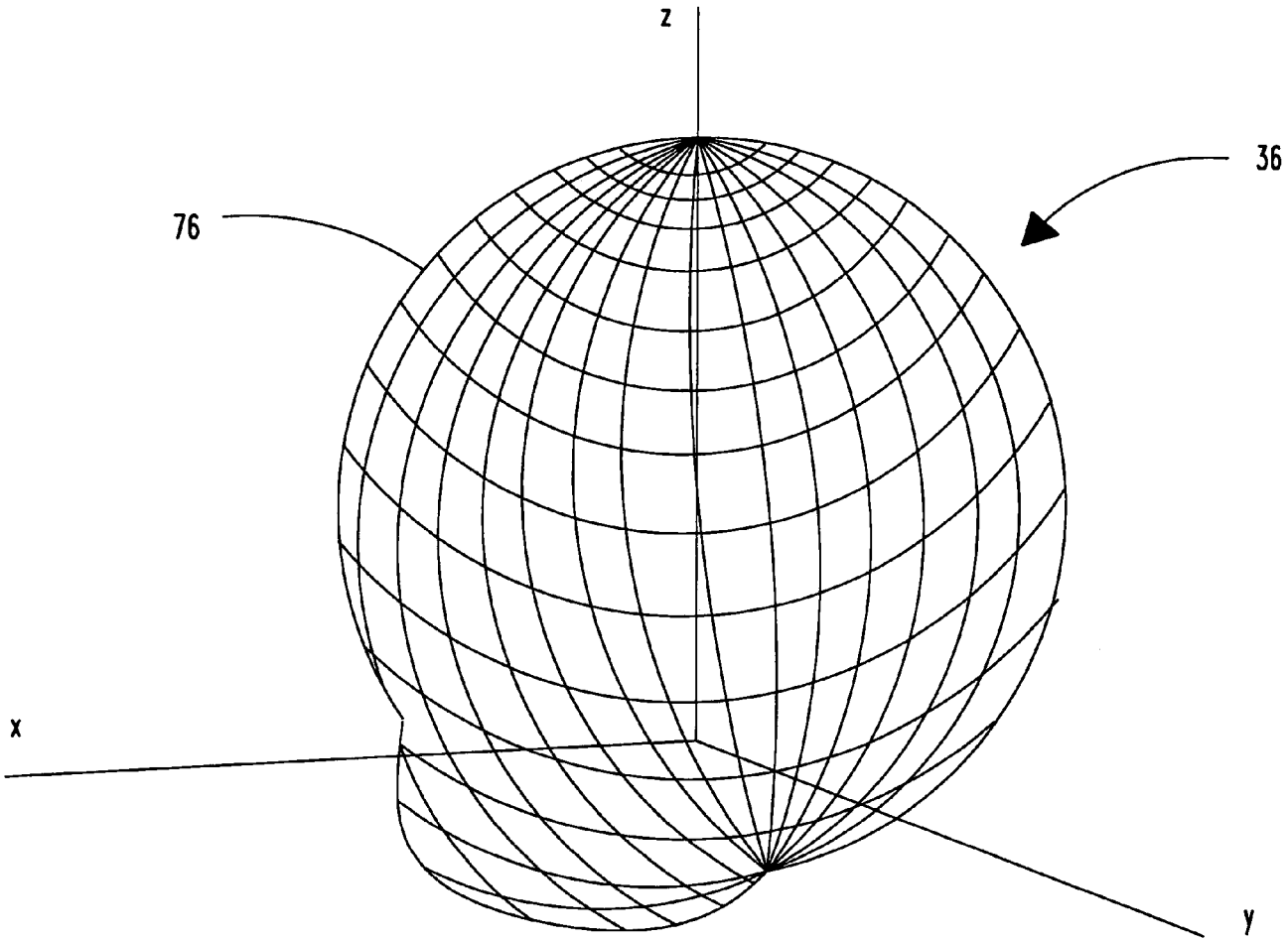
FIG. 6 is a three dimensional view of a radiation pattern formed by the antenna of the present invention.

During actuation of the antenna 10, the feed stem 30 is conductive to an energized feed source (not shown). Radio-frequency energy from the feed stem 30 continues onto the frustum 12 with the energy disbursing as a current distribution along the interior surface of the frustum. The energy from the feed stem 30 also continues to the receiver plate 24 by way of the rod 32 with the result of a current distribution across the receiver plate. The distribution of current amplitude and phase from the surface of the frustum 12 and the receiver plate 24 contributes to a hemispherical radiation or beam pattern 36, shown in FIG. 6. The hemispherical radiation pattern 36 is advantageous because when the antenna 10 is placed on the ocean surface, the radiation pattern in the air space above the ocean surface (shown by the area 76 above the "x" and "y" axis) does not contain nulls. As such, the radiation pattern in the air space permits full directionalized reception from satellites.

Furthermore, the antenna 10 reduces the degradation and associated problems with detuning occurring during with vary sea states. Specifically, the impedance matching of the frustum 12, the feed stem 30 and the rod 32 control the impedance influence of the detuning. Also, the structure of the curved frustum 12 removes the edges of a typical patch antenna in which the edges of the typical patch antenna are subject to detuning and quicker degradation.

An additional feature of the present invention is that the structural ratio (identified by the wavelength dimensioning above) of the various components of the antenna 10 allows the hemispherical radiation pattern 36 while maintaining the compactness of the antenna 10. The compactness of the antenna 10 is advantageous for many reasons including detection minimalization and reduced drag of the enclosing towing body. In relation to conventional GPS antennas, the compactness of the antenna 10 with its frustum 12 and receiver plate 24 does not require a large ground plane in order to generate the hemispherical radiation pattern 36.

In defining the compactness feature, the outer physical boundary of the antenna 10 is based on the size and placement of the open end 14 and the closed end 16 of the frustum 12. For example, the diameters of the open end 14 and the closed end 16 are $2\lambda/5$ and $\lambda/5$ respectively with a distance of $\lambda/9$ between the open end and the closed end. Any remaining structure of the antenna 10 would be within a circumferential boundary created by the above dimensions.

Furthermore, the all-metallic structure of the antenna 10 does not require a ceramic dielectric substrate yet allows transmission and reception at a large instantaneous operating bandwidth as exemplified by the antenna use with IRIDIUM and global positioning signals described above.

Thus by the present invention its objects and advantages are realized and although preferred embodiments have been disclosed and described in detail herein, its scope should be determined by that of the appended claims.

What is claimed is:

1. An apparatus for maintaining a receiver section of an antenna at a facing position to the force of gravity, said apparatus comprising:

a gimbal with a rotation on at least two axes; and an antenna formed as a hollowed frustum having a closed end at its decreased diameter with a feed stem removably conductive to a radio-frequency energy source, said feed stem extending through the closed end to attach said receiver section, and said frustum having an open end pivotably attached to said gimbal with the open end encompassing said receiver section at the increased diameter of said frustum and with the open end pivotable on one of the at least two axes;

wherein a movement of said antenna causes a pivoting action of the open end in relation to said gimbal and further causes movement of at least one of the axes in relation to each other such that said receiver section maintains the facing position.

2. The apparatus in accordance with claim 1, wherein said apparatus further comprises an electrically transparent container mechanically attached to said gimbal and encompassing said antenna and said gimbal in which said container is suitable for towing on an ocean surface.

3. An antenna comprising:

a hollowed frustum with a closed end at its decreased diameter and an open end at an increased diameter;

a feed stem positioned at and extending through the closed end to an interior of said hollowed frustum, said feed stem removably conductive at one end to a radio-frequency energy source; and a receiver section connected to an opposite end of said feed stem;

wherein radio-frequency energy from the radio-frequency source distributes from said feed stem as current across said frustum and said receiver section such that a hemispherical radiation pattern is formed by said frustum and said receiver section.

4. The antenna in accordance with claim 3, wherein said antenna is formed of a metallic construction.

5. The antenna in accordance with claim 4, wherein said receiver section is a plate extending from the increased diameter beyond a longitudinal axis of said frustum.

6. The antenna in accordance with claim 5, wherein the longitudinal axis is perpendicular to the decreased diameter and the increased diameter of said frustum.

7. The antenna in accordance with claim 6, wherein an integral base ring collinear with the increased diameter of said frustum is positioned at the open end of said frustum.

8. The antenna in accordance with claim 7, wherein the decreased diameter, the increased diameter and a distance between the decreased diameter and the increased diameter of said frustum is sized based on a frequency of 1625 MHz.

9. The antenna in accordance with claim 7, wherein the decreased diameter, the increased diameter and a distance between the decreased diameter and the increased diameter of said frustum is sized from a free-space wavelength of said antenna.

10. The antenna in accordance with claim 9, wherein the free-space wavelength is based on a mean frequency of said antenna.

11. The antenna in accordance with claim 10, wherein the mean frequency is the based on the square root of the multiplication of the frequencies receivable from global positioning satellites.

12. The antenna in accordance with claim 9, wherein the distance between the increased diameter and the decreased diameter of said frustum is the free-space wavelength divided by a factor of nine, the increased diameter is twice the free-space wavelength divided by a factor of five with the decreased diameter being half of the increased diameter;

wherein said plate extends from a closed width at the increased diameter, the extension of said plate sized at the free-space wavelength divided by three with the closed width and an open width of said plate at ten percent less than the extension.

13. The antenna in accordance with claim 12, wherein a length and a diameter of said feed stem is the free-space wavelength divided by a factor of ten and thirty respectfully wherein said feed stem contacts said plate at the free-space wavelength divided by a factor of eleven from the open width of said plate.

* * * * *